United States Patent [19]

Duester et al.

[11] Patent Number: 4,826,056

[45] Date of Patent: May 2, 1989

[54] HANGER WITH ADJUSTABLE GARMENT CLAMPS

[75] Inventors: Everett Duester; Russell O. Blanchard, both of Zeeland, Mich.

[73] Assignee: Batts, Inc., Zeeland, Mich.

[21] Appl. No.: 201,587

[22] Filed: Jun. 2, 1988

Related U.S. Application Data

[63] Continuation of Ser. No. 941,090, Dec. 12, 1986, abandoned.

[51] Int. Cl.[4] ..... A47G 25/48

[52] U.S. Cl. ..... 223/96; D6/326; 24/487; 24/542

[58] Field of Search ..... 223/90, 91, 93, 96; 24/487, 542; D6/326

[56] References Cited

U.S. PATENT DOCUMENTS

| | | | |
|---|---|---|---|
| 2,408,145 | 9/1946 | Johnson | 223/96 |
| 2,421,307 | 5/1947 | Albrecht | 223/96 |
| 2,889,092 | 6/1959 | Gibron | 223/91 |
| 2,924,363 | 2/1960 | Reller et al. | 223/93 |
| 3,209,966 | 10/1965 | Wach | 223/93 |
| 4,034,903 | 7/1977 | Batts | 24/542 X |
| 4,054,234 | 10/1977 | Thomas | 223/91 |

*Primary Examiner*—Robert R. Mackey

*Attorney, Agent, or Firm*—Price, Heneveld, Cooper, DeWitt & Litton

[57] ABSTRACT

An article hanger particularly useful for clothing has an elongated, non-circular, beam-like body along which article gripping clamps are slidably mounted for adjustment in spacing. The beam-like body passes through the article receiving chamber formed between the jaws of the clamps. The clamps have spaced strap-like members which extend around and embrace the beam-like body. The face of the body directed into the chamber is exposed between the straps and has an irregular or unsmooth surface against which the article is pressed by the clamps to create a frictional grip resisting creep of the clamp lengthwise of the body. Also the spring clip holding the clamp closed engages the back face of the body to further resist creep.

16 Claims, 3 Drawing Sheets

HANGER WITH ADJUSTABLE GARMENT CLAMPS

This application is a continuation of U.S. patent application Ser. No. 941,090, filed Dec. 12, 1986, now abandoned.

FIELD OF THE INVENTION

This invention relates to hangers for articles and particularly to hangers designed for both transport and display of garments or similar products. The hanger is of the article clamping type and is designed to be molded of plastic.

BACKGROUND OF THE INVENTION

Many types of articles and, particularly, clothing come in various sizes and weights requiring hangers to be of a variety of widths, if the article is to be properly suspended or draped. Particularly is this true of garment hangers of the laterally spaced clamp type frequently used for transport and display purposes. To eliminate the necessity for manufacturing and stocking garment hangers in a range of sizes, hangers have been developed provided with clamps slidably mounted on the garment body making it possible to adjust the spacing between the clamps. Providing adjustability has introduced a new problem under certain circumstances of hanger use, that being clamp creep, that is, the tendency of the clamps to shift toward each other due to garment weight during transport and handling and, in some cases, even without the intervention of these factors.

To stabilize the clamp's position on the body, the clamps have been designed to have a firm frictional engagement with the clamp body. This has been found to work satisfactorily with lighter weight and smaller garments that do not require a wide and thus heavy quantity of fabric to be suspended between the clamps. However, with garments of heavier fabrics, such as winter wear, the weight of the panels of fabric suspended between the clamps is sufficient to pull the clamps toward each other despite the frictional resistance. This is particularly undesirable in the retail display of garments when it is desirable to display the garments with some degree of applied tension so that they are displayed to their best advantage. In the case of garments of the heavier fabrics, it is not practical to increase the frictional engagement between the clamps and the hanger body to a point sufficient to eliminate this type of creep because this all but eliminates the adjustability of the clamps and thus the practicality of the hanger. To add locking mechanisms to the clamps is not practical because of cost. It also complicates the hanger's operation. This latter is important because, in many retail operations, the customer must, or at least will, manipulate the hanger. If it is difficult or clumsy to use, the result could be loss of sales due to customer frustration and/or damage to the garment. Providing a practical and inexpensive solution to this problem is the purpose of this invention.

BRIEF DESCRIPTION OF THE INVENTION

The invention provides a means for preventing clamp creep along the hanger body without the necessity for providing a high degree of frictional engagement between the clamp and the hanger body, particularly when the clamp is in release or open position. The invention provides a means of utilizing garment to hanger body engagement when the clamp is closed to provide the necessary frictional resistance to creep to stabilize the position of the clamps. The invention also provides a means for materially increasing the clamp to hanger body resistance to movement when the clamp is closed, yet entirely releasing this additional resistance upon opening the clamp.

DESCRIPTION OF THE PREFERRED EMBODIMENT

Figure 1:
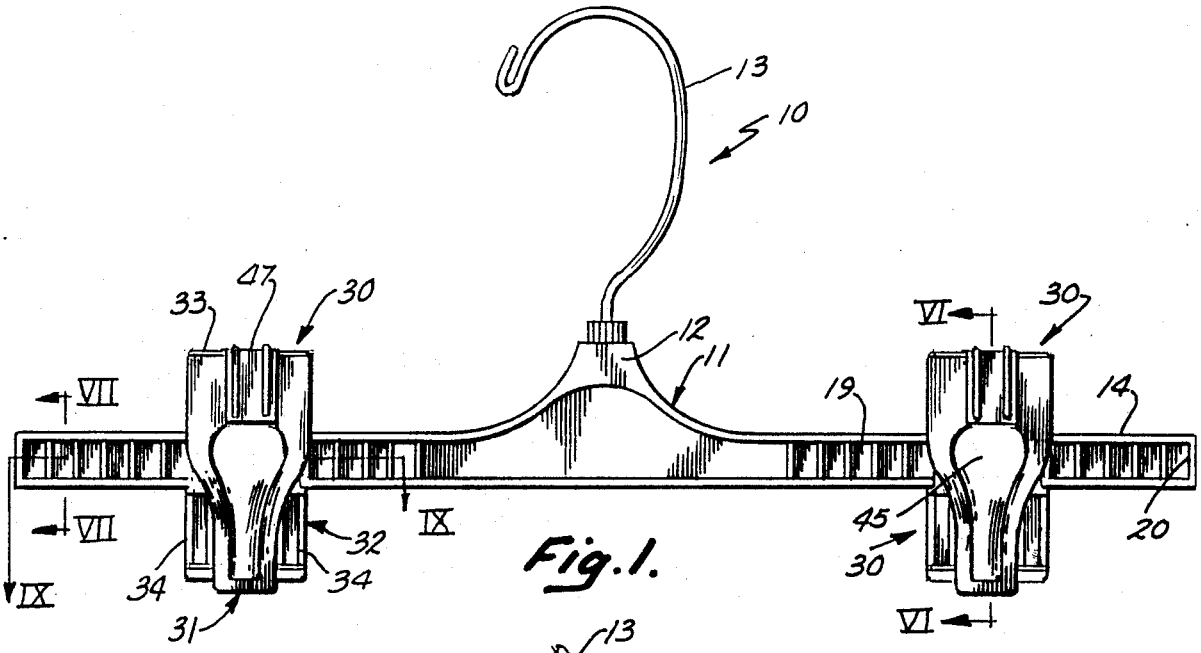
FIG. 1 is a front elevation view of the hanger of this invention with the clamps illustrated in closed position.
Figure 2:
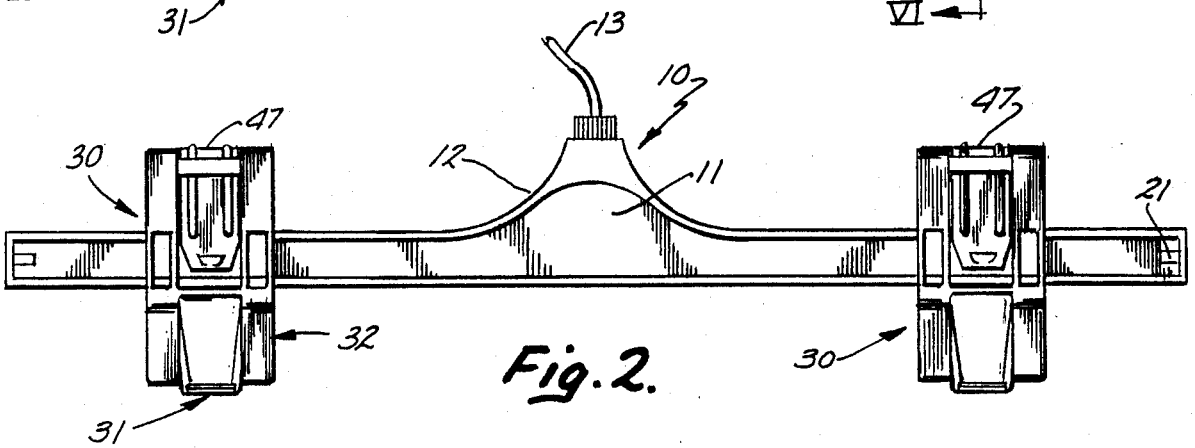
FIG. 2 is a rear elevation view of the hanger illustrated in FIG. 1.
Figure 3:
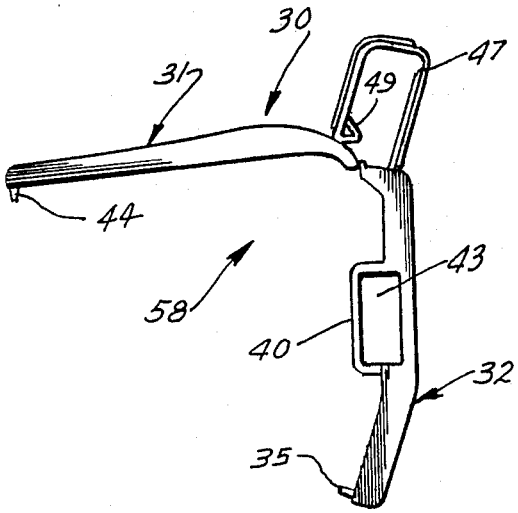
FIG. 3 is a end elevation view of one of the clamps illustrated in open position.

Referring to FIG. 1 of the drawings, the numeral 10 indicates a hanger having a body 11. The center of the body is vertically enlarged and provides a boss 12 for mounting the support hook 13. In the particular construction illustrated, the hook 13 is of wire and is secured to the boss in such a manner that the body and the weight of whatever garments are secured to the hanger will be supported from the hook. The body 11 is molded of plastic of a suitable type such as styrene or polypropolyene. It will be recognized that instead of a wire hook the hanger body could be designed with a molded plastic hook integral with the body. Such constructions have long been used in the molded plastic hanger art.

Figure 7:
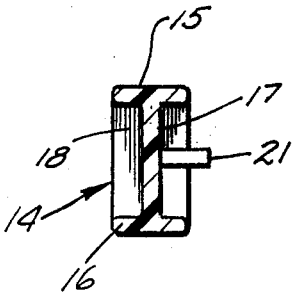
FIG. 7 is a sectional elevation view taken along the plane VII—VII of FIG. 1.

The hanger body 11, except in the central area of the boss 12, is in effect an elongated beam of rectangular cross section having arms 14 extending from both sides of the central boss. The arms 14 are identical in length and cross section. Preferably, the beam has a greater vertical dimension than front to back dimension as is best seen in FIG. 7 to resist bending due to the weight of the garments. For purposes of rigidity, it is of I-beam cross section construction having an upper flange 15 and a lower flange 16 interconnected by a vertical web 17.

Figure 9:
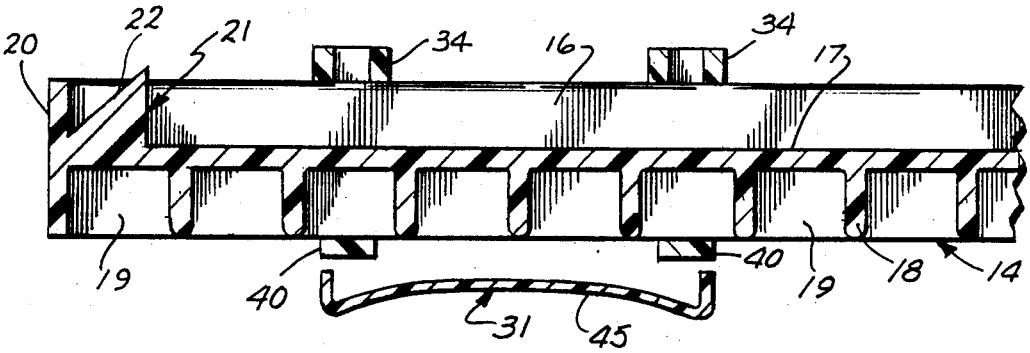
FIG. 9 is an enlarged, fragmentary, sectional view taken along the plane IX—IX of FIG. 1.

Extending from the web 17 forwardly to the front edge of the flanges 15 and 16 are a plurality of vertical ribs 18 which are integral with and extend vertically between the flanges 15 and 16 and are also integral with the central web 17. The ribs are equally spaced along the front face of the beam, except that they are omitted in the general area of the central boss 12 for reasons which will become obvious subsequently. The ribs create a plurality of forwardly opening pockets 19 along that portion of each of the arms where the garment clamps can be expected to be located when the hanger is in use (FIG. 9). No ribs are provided along the back face of the body. Each end of the body is closed by an end web 20. Immediately adjacent each end web a stop 21 is provided on the rear face of the body which is integral with the central web 17 and has an outwardly facing and rearwardly extending inclined surface 22 which extends beyond the plane of the rear face of the body 11 (FIG. 9). The materials used for molding the body 11 and its dimensions are such that it will remain rigid and basically undeflected by the weight of any of the articles which might reasonably be expected to be suspended from the hanger.

Figure 5:
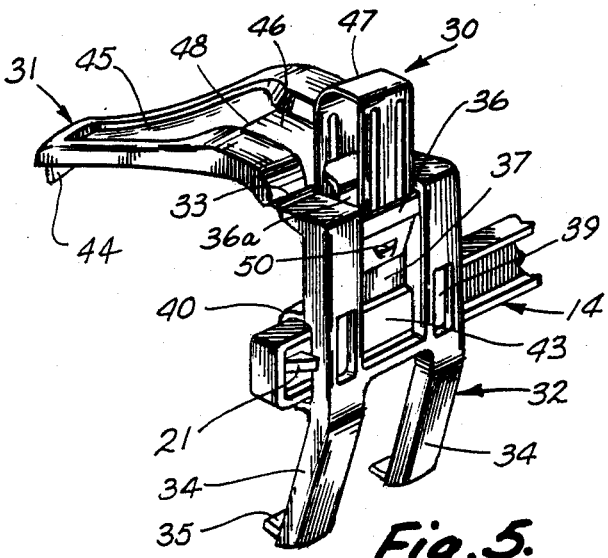
FIG. 5 is a fragmentary, rear, oblique view of one of the clamps in open position.
Figure 8:
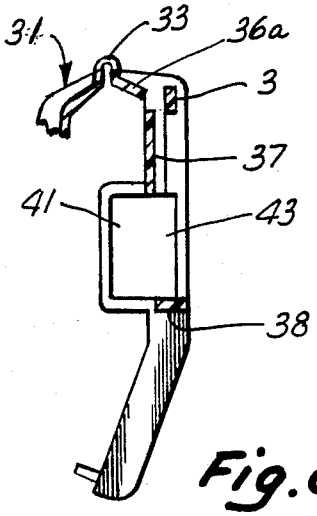
FIG. 8 is a sectional elevation view of the rear leg only of the clamp taken along the same plane as FIG. 6.
Figure 4:
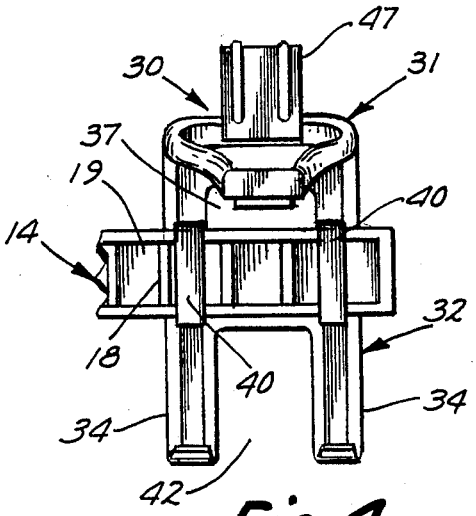
FIG. 4 is a fragmentary front elevation view of one of the clamps in open position.
Figure 10:
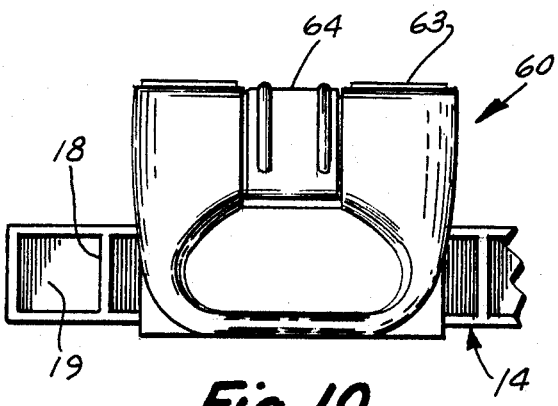
FIG. 10 is a fragmentary front elevation view of a modified construction for the hanger of this invention.
Figure 12:
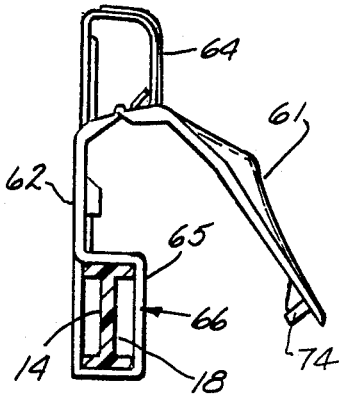
FIG. 12 is a view of the hanger illustrated in FIG. 10 shown in open position.
Figure 13:
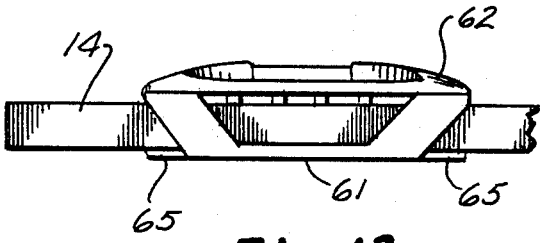
FIG. 13 is a bottom view of the hanger illustrated in FIG. 10.
Figure 14:
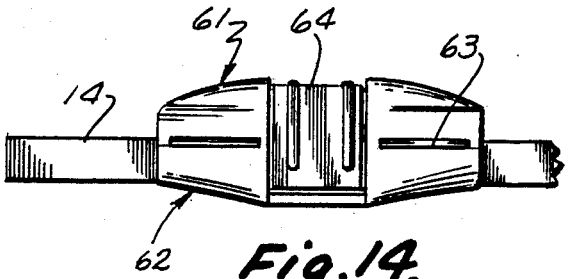
FIG. 14 is a top view of the hanger illustrated in FIG. 10.

Articles are supported from the hanger by means of a pair of clamps 30. Each of the clamps has a front leg 31 and a back leg 32, which legs are integrally joined together at their upper ends by a web forming a hinge 33. The front and rear legs and the hinge are integral and are molded as a single piece from a suitable plastic material such as polypropylene. The back or rear leg 32 has a pair of spaced side members 34, the upper ends of which extend forwardly and are integral with the hinge 33 (FIGS. 5 and 8). The side members 34 extend downwardly and at their lower ends terminate in forwardly directed article gripping teeth 35. Between the hinge 33 and the lower end of the side members, the side members are joined together by a guide bar 36, a panel 37 and a cross member 38 (FIGS. 5 and 8). They are also connected by a cross bar 36*a*. As shown in FIG. 8, the panel 37 is L-shaped with a short leg extending forwardly at the top of the panel. Vertically elongated openings 39 are provided in each of the side members 34. The openings provide means for a mold insert to extend through the side members to form the inwardly extending U-shaped straps 40. The size and shape of the straps 40 is such as to form a rectangular shaped track or passage 41 between the straps and the side members 34 of a size and shape to closely seat around the arms 14 of the hanger body 11 and, thus, slidably support the clamps on the hanger body. The shape of the passage is such as to positively hold the clamps against pivotal movement around the arms. The back leg is open from the ends of the straps to its lower end, thus, forming a generally upwardly directed U-shaped opening 42. The area between the bottom of the panel 37 and the cross member 38 is also open, providing an aperture 43 which extends between the side members 34 and is basically of the same vertical height as the passage 41. The functional importance of this opening will be explained subsequently.

The front leg 31, at its upper end, is of the same width as the rear leg 32. However, the lower portion of the front leg is tapered so that its lower end is of a width which will pass through the opening 42. The central portion of the front leg 31 is recessed at 45 throughout most of its height (FIG. 5). The upper portion 46 of this recess forms a guide track for the U-shaped spring clip 47 which, when the clamp is closed, seats down over both the front and rear legs. Where the guide track 46 merges into the lower portion of the recess 45, a rearwardly offset step 48 is provided in the face of the recess which cooperates with the inwardly extending flange 49 on the clamp 47. The engagement between the step and flange provides a hold down for the spring clip when it is fully seated.

The rear leg of the clip passes between the guide bar 36 and the rear face of the panel 37 in the track defined between the inner edges of the side members 34. The lower end of the spring clamp has an outwardly offset stop 50 designed to engage the guide bar 36 to prevent the spring clip from being inadvertently detached from the clamp. The rear leg of the spring clip is substantially longer than the front leg and, thus, when the clamp is fully depressed or seated, the lower portion extends almost entirely across the rear face of the aperture 43. Thus, it engages and by reason of its resilience, presses firmly against the top flange of the arm portion 14 of the body 11. The concept of the spring clip 47 and of utilizing it to resiliently hold a pair of clamping jaws of a article hanger in closed position and being mounted in a track to guide its vertical movement between clamped and released positions is disclosed in U.S. Pat. No. 3,767,092 issued Oct. 23, 1973 to J. F. Garrison et al. However, utilizing the spring clip to engage the support for the clamp is new.

To assemble the clamps to the hanger body, the end of one of the arms 14 is threaded through the passages 41 created by the straps 40 and, as this is done, the stop 21 is forced past the side members 34. This is possible because the clamps having been molded of a plastic material having a limited degree of resilience can be sufficiently deflected to enlarge the passages 41 enough to allow the side members to flex to pass over the stop 21. This is repeated on each end of the hanger body 11. This is done while the spring clip 47 is in raised or released position. Once the clamps have been mounted on the bar, because the stops 21 have an inwardly directed face which is basically perpendicular to the central web 17 the clamps cannot readily be made to disengage the bar.

So long as the spring clip 47 remains in raised or release position, the clamps can be moved reasonably freely lengthwise of the arms 14. However, when the spring clip is pushed down into clamp closing position, the rear leg of the clip passes over and presses tightly against the upper flange of the arm on which the clamp is mounted. Since the spring clip is resilient and is biased to press inwardly, this creates frictional resistance to movement of the clamp lengthwise of the bar. Thus, this is an important and very useful in contribution to stabilizing the position of the clamp once the garment has been secured to the hangers.

Figure 6:
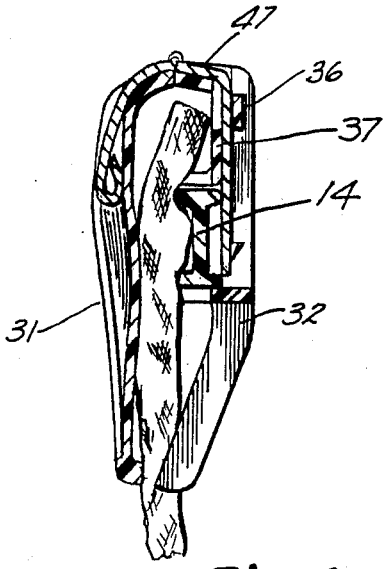
FIG. 6 is a sectional elevation view taken along the plane VI—VI of FIG. 1, illustrating the clamp in closed article gripping position.

Even with the resistance created by the spring clip 47 bearing against the back face of the top flange of the body or bar, particularly in the case of garments which are wide and, therefore, have a central portion of substantial width, the weight of the garment between the clamps can be sufficient to cause the clamps to creep toward each other even though such movement is resisted by the engagement between the spring clip and the back of the arms. This is particularly true when the hangers are used for transport. The ribs 18 are provided to overcome this problem. When a garment is placed with its upper end, normally the waistband, seated in the chamber 58 created between the legs of the clamp when it is closed, the garment is not only gripped between the teeth 35 and 44, it is also squeezed against the front face of the body 11 that is exposed to the chamber 58 between the straps 40 (FIG. 6). The squeezing action is created not only by the fact that the exposed face of the body 11 extends a substantial distance into chamber 58, but also by the fact that the central portion of the front leg 31 which lies behind the recess 45 is curved inwardly toward the body 11 and, thus, squeezes the garment firmly against the front face of the body. Portions of the garment are forced to protrude into the pockets or spaces 19 between the ribs 18. Thus, the garment's engagement with the ribs provides a positive interference resistance to the movement of the clamps 30 lengthwise of the body. In this manner, the spring clip's engagement with the back face of the body and the garment engagement of the ribs 18 cooperate to prevent lateral movement of the clamps along the body, even though the garment may be heavy and tensioned between the clamps so that the garment presents a neat and pleasing experience. This is very important in making the hanger acceptable to those who would use it for garment display at the retail level.

FIGS. 10–15 illustrate a modification of this invention. The clamp 60 has a pair of jaws 61 and 62 joined by an integral hinge 63 whereby the clamp can be opened and closed. Closure of the clamp is effected by a U-shaped spring clip 64 which preferably is of the same design and functional characteristics as the spring clip 47. Garment hangers with this type of clamp are disclosed in the previously mentioned U.S. Pat. No. 3,767,092. When the spring clip 64 is in the raised position the clamp is released and can be opened and when depressed, the clamp is closed.

The rear jaw 62 at its lower end has a pair of laterally spaced forwardly extending straps 65 which form a pair of rectangular passages of a size and shape to closely fit around and embrace one of the arms 14 of a hanger. These straps serve the same function as the straps 40 but they are positioned adjacent the lower ends of the jaws 61 and 62. Thus, the front face of the arm 14 passing through the passage 66 created by the straps is vertically aligned with the lower end of the jaw 61. This arrangement provides positive pressure against the garment, forcing it into engagement with the front face of the body and in the case of the body 14 against the ribs 18. Since most of the chamber 70 is above the body 14, the waist band of the garment may be entirely above the body 14 or the front jaw will clamp against the waist band. In either case, the clamp will provide a positive grip against release of the garment. It will also provide a positive anti-creep engagement with the body 14.

Figure 11:
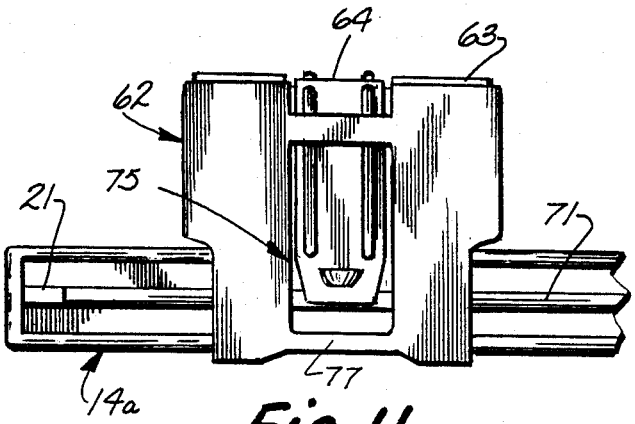
FIG. 11 is a fragmentary rear elevation view of the hanger shown in FIG. 10.
Figure 15:
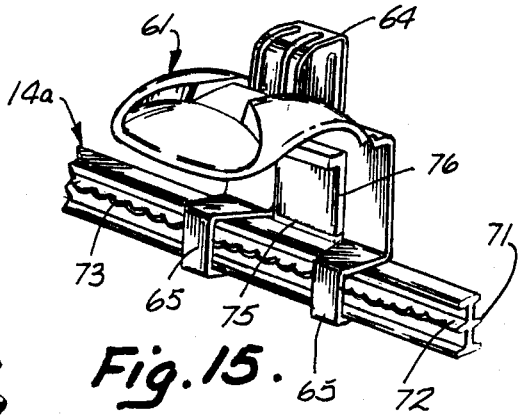
FIG. 15 is an oblique view of the hanger illustrated in FIG. 10, shown in open position.

FIGS. 11 and 15 illustrate a modified construction for the hanger body. In this construction, the body **14*a* has a center flange or rib 72 on the front face. The front center rib 72 has a plurality of teeth 73 in its front face. These teeth may be pointed or rounded, as illustrated. These teeth either align with or are slightly above the gripping teeth 74 on the front jaw. They provide a positive anti-creep grip on the garment. Preferably, rear jaw 62 of the clamp 60 has a central elongated opening 75 between the lower end of the panel 76 and the base tie bar 77 connecting the sides of the rear jaw together at the rear end of the straps 65. This opening permits the lower end of the spring clip 64 to frictionally engage the top flange and rear center rib of the body providing a positive resistance to creep when the clamp is closed (FIG. 11**).

It will be recognized that the main body of the hanger can be molded in relatively simple molds and, thus, both its mold cost and the actual manufacturing process is materially simplified and the cost reduced. In addition, only a single type of mold cavity is needed to make all of the necessary clamps, since all of the clamps are identical. Further, since the clamps are molded separately from the body of the hanger, the cost of the necessary molds is substantially reduced, since both the size and the complexity of the molds is materially lessened. This is accomplished without adversely affecting the functional characteristics of the hanger.

Having described the invention and its operation, it will be recognized that various modifications of the invention can be made without departing from the principles of the invention. Such modifications are to be considered as included in the hereinafter appended claims, unless these claims by their language expressly state otherwise.

We claim:

1. A garment hanger having an elongated body of non-circular cross section and means for suspending said body from a support, article clamps slidably mounted on and for movement along said body, each of said article clamps having means on a first leg holding said clamp against pivotal movement about the longitudinal axis of said body and a second leg pivotally secured to said first leg at a point above said body and forming a vertically elongated article receiving chamber between said legs; said body extending through said chamber between said first and second legs and spaced from both the top and bottom of said chamber; said means on said first leg holding said clamp against pivotal movement and engaging said body for sliding movement therealong and having an opening exposing the face of said body facing said second leg to the exterior of said chamber; means on said second leg for pressing a garment against the exposed portion of said body; the face of said body facing said second leg having a plurality of vertically arranged closely spaced ribs projecting toward said second leg and exposed through said opening and forming a plurality of pockets between said ribs for engaging and gripping a garment pressed against them with a portion of the garment being displaced into said pockets when said second leg is shifted to clamp closing position and means for pressing said second leg into closed article clamping position toward said first leg.

2. A garment hanger having an elongated body and means for suspending said body from a support, said body having a pair of straight, oppositely extending arms of non-circular cross section, article clamps slidably mounted on and for movement along said arms, said article clamps each having front and back jaws pivotally joined at a point spaced from and above said arms forming an article receiving and clamping chamber between them and releasable means for holding said front jaw in closed position; each of said arms extending laterally through the chamber of one of said clamps, support means on said back jaw of each of said clamps closely fitting around an arm of said body and providing an opening exposing the face of said arm to the interior of said chamber and slidably supporting said clamps while holding them against pivotal movement about the longitudinal axis of said arm; the faces of said arms facing into said chambers having gripping means forming a plurality of recessed pockets in the face of said arms opening toward said front jaws, each of which pockets being surrounded by ridges some of which are generally vertical and extend toward said front jaws, said front jaws each having an inwardly extending portion for pressing a garment against said gripping means and at least partially into said pockets when said clamps are closed and said releasable means is in jaw closing position for holding the garment against slippage both lengthwise and vertically of said arms.

3. The garment hanger described in claim 2 wherein said support means are straps forming passages for said arms of generally rectangular cross section.

4. The garment hanger described in claim 3 wherein stop means are provided at each end of said body to prevent said straps from being moved off the end of said body.

5. The garment hanger described in claim 4 wherein said straps have limited resiliency and said stop means are wedge shaped having a face forming a ramp facing the adjacent end and a shoulder facing toward the midpoint of said body which is perpendicular to the axis of said body whereby said clamps can be assembled to said body by resilient deflection of the back jaws of said clamps in the area of said straps but prevented from detachment by said shoulders.

6. The garment hanger described in claim 5 wherein said arms are of generally I-beam cross section and a substantial portion of the rearward extension of said stop means is recessed within the back face of said arms.

7. The garment hanger described in claim 2 wherein the front faces of said arms have forwardly extending upper and lower flanges forming a longitudinally extending recesses between them, said vertical ones of said ridges being ribs extending between said flanges in said recesses.

8. The garment hanger described in claim 7 wherein said ribs are equally spaced.

9. The garment hanger described in claim 8 wherein the forward faces of said ribs are co-planar with the forward faces of said flanges.

10. A garment hanger having a body characterized by a pair of elongated rectangular arms and means intermediate the ends of said body for suspending it from a support, a clamp mounted on each of said arms; each said clamp having a pair of jaws one of which is pivotally secured to the other forming a garment receiving chamber therebetween; the other of said jaws having a pair of spaced apart straps extending into said chamber, one adjacent each side edge of said other jaw and defining a passageway through which an associated one of said arms may move slidably with the inner face of said arm exposed between said straps to a garment received in said chamber, the inner face of each said arm directed toward said one jaw having an irregular surface forming garment gripping means at least some of which extend vertically and against which a garment is pressed by said one jaw when it is in closed position and means for holding said one jaw in closed position.

11. The garment hanger as described in claim 10 wherein said irregular surface is a plurality of alternating recesses and ridges.

12. The garment hanger as described in claim 10 wherein said irregular surface is a longitudinal rib intermediate the top and bottom of each said arm, said rib having a surface formed of a plurality of teeth facing toward said one jaw.

13. The garment hanger as described in claim 12 wherein said teeth are rounded.

14. The garment hanger as described in claim 12 wherein said arms are each of I-beam cross section.

15. The garment hanger described in claim 10 wherein said straps are adjacent the bottom of said other jaw, said one jaw having an article gripping tooth adjacent its free end positioned to force the garment against said irregular surface of the associated arm passing through said straps.

16. A garment hanger having a body characterized by a pair of elongated rectangular arms and means intermediate the ends of said body for suspending it from a support, a clamp mounted on each of said arms; each said clamp having a pair of jaws one of which is pivotally secured to the other forming a garment receiving chamber therebetween; the other of said jaws having a pair of straps extending into said chamber, said straps being faced apart with one being adjacent each side edge of said other jaw and defining a passageway through which an associated one of said arms may move slidably with the inner face of said arm exposed to a garment received in said chamber, said straps being adjacent the bottom of said other jaw, th inner face of each said arm directed toward said one jaw having an irregular surface forming garment gripping means extending both vertically and horizontally and said other jaw having an article gripping tooth adjacent its free end positioned to force the garment against said irregular surface of the arm passing through said straps and means for holding said one jaw in closed garment pressing position.

* * * * *